US007134930B2

(12) United States Patent
Arias

(10) Patent No.: US 7,134,930 B2
(45) Date of Patent: Nov. 14, 2006

(54) COLLAPSIBLE FLOTATION DEVICE

(75) Inventor: David Arias, Virginia Beach, VA (US)

(73) Assignee: Kelsyus, LLC, Virginia Beach, VA (US)

( * ) Notice: Subject to any disclaimer, the term of this patent is extended or adjusted under 35 U.S.C. 154(b) by 0 days.

(21) Appl. No.: 11/143,703

(22) Filed: Jun. 3, 2005

(65) Prior Publication Data

US 2005/0215141 A1 Sep. 29, 2005

Related U.S. Application Data

(63) Continuation of application No. 10/847,339, filed on May 18, 2004, which is a continuation of application No. 10/295,906, filed on Nov. 18, 2002, which is a continuation of application No. 09/772,739, filed on Jan. 30, 2001, now Pat. No. 6,485,344.

(60) Provisional application No. 60/238,988, filed on Oct. 10, 2000.

(51) Int. Cl.
*B63C 9/28* (2006.01)

(52) U.S. Cl. ..... 441/131; 441/40

(58) Field of Classification Search ..... 441/40, 441/131

See application file for complete search history.

(56) References Cited

U.S. PATENT DOCUMENTS

| | | | |
|---|---|---|---|
| 722,801 | A | 3/1903 | Bourne, Jr. |
| 772,690 | A | 10/1904 | Baswitz |
| 856,279 | A | 6/1907 | Moore |
| 1,190,743 | A | 7/1916 | Fageol |
| 1,479,903 | A | 1/1924 | Erland |
| 1,960,474 | A | 5/1934 | Browne |
| 2,119,023 | A | 5/1938 | Pickard |
| 2,173,963 | A | 9/1939 | Eubank |
| 2,190,566 | A | 2/1940 | Julian |
| 2,207,025 | A | 7/1940 | Rison |
| 2,334,924 | A | 11/1943 | Hansen |
| 2,344,010 | A | 3/1944 | Walsh |
| 2,357,789 | A | 9/1944 | Levy |
| 2,360,715 | A | 10/1944 | Perry |
| 2,420,344 | A | 5/1947 | Alexander |
| 2,442,105 | A | 5/1948 | Vacheron |
| 2,637,861 | A | 5/1953 | Kethledge |
| 2,731,997 | A | 1/1956 | Muth et al. |
| 2,803,291 | A | 8/1957 | Meyer |
| 2,803,839 | A | 8/1957 | Mosley |
| 2,870,464 | A | 1/1959 | Lalick |
| 2,953,184 | A | 9/1960 | Erstad |
| 3,052,895 | A | 9/1962 | Lo Vico |
| 3,336,610 | A | 8/1967 | Geddings |
| 3,339,218 | A | 9/1967 | Stamberger |

(Continued)

FOREIGN PATENT DOCUMENTS

EP 0 974 293 A2 1/2000

(Continued)

OTHER PUBLICATIONS

*Swimways Corp.*, v. *Overbreak, LLC*, Order, Case No. 1:04cv627, dated Jan. 18, 2005.

(Continued)

*Primary Examiner*—Jesus D. Sotelo

(57) ABSTRACT

A device comprises a spring and a sleeve. The spring is configured to form a closed loop. The spring is moveable between a coiled configuration when the spring is collapsed and an uncoiled configuration when the spring is expanded. The spring defines a circumference while in the uncoiled configuration. The spring is disposed within the sleeve. The sleeve includes an inflatable portion disposed about at least a portion of the circumference.

19 Claims, 5 Drawing Sheets

U.S. PATENT DOCUMENTS

| | | | |
|---|---|---|---|
| 3,602,930 | A | 9/1971 | Channon |
| 3,775,782 | A | 12/1973 | Rice et al. |
| 3,842,454 | A | 10/1974 | Young |
| 3,860,976 | A | 1/1975 | Suyama |
| 3,862,876 | A | 1/1975 | Graves |
| 3,960,161 | A | 6/1976 | Norman |
| 3,990,463 | A | 11/1976 | Norman |
| 4,097,944 | A | 7/1978 | Yulish |
| 4,200,942 | A | 5/1980 | Case |
| 4,231,125 | A | 11/1980 | Tittl |
| D261,464 | S | 10/1981 | Smith |
| 4,296,788 | A | 10/1981 | Slater |
| 4,435,236 | A | 3/1984 | Inae et al. |
| 4,478,587 | A | 10/1984 | Mackal |
| 4,512,049 | A | 4/1985 | Henry |
| 4,561,480 | A | 12/1985 | Underwood et al. |
| 4,576,375 | A | 3/1986 | Roberts |
| 4,709,430 | A | 12/1987 | Nicoll |
| 4,766,918 | A | 8/1988 | Odekirk |
| 4,815,784 | A | 3/1989 | Zheng |
| 4,825,892 | A | 5/1989 | Norman |
| 4,858,634 | A | 8/1989 | McLeese |
| 4,861,300 | A | 8/1989 | Casagrande et al. |
| 4,942,838 | A | 7/1990 | Boyer et al. |
| 4,944,707 | A | 7/1990 | Silverglate |
| 4,946,067 | A | 8/1990 | Kelsall |
| 4,951,333 | A | 8/1990 | Kaiser et al. |
| 4,976,642 | A | 12/1990 | Wilkie |
| 4,986,781 | A | 1/1991 | Smith |
| 5,024,262 | A | 6/1991 | Huang |
| 5,038,812 | A | 8/1991 | Norman |
| 5,045,011 | A | 9/1991 | Lovik |
| 5,056,172 | A | 10/1991 | Kaiser et al. |
| 5,059,463 | A | 10/1991 | Peters |
| 5,070,807 | A | 12/1991 | Lewis |
| 5,088,723 | A | 2/1992 | Simmons |
| D325,489 | S | 4/1992 | Pratt |
| 5,116,273 | A | 5/1992 | Chan |
| 5,123,869 | A | 6/1992 | Schipmann |
| D328,324 | S | 7/1992 | Wang |
| 5,163,192 | A | 11/1992 | Watson |
| 5,163,461 | A | 11/1992 | Ivanovich et al. |
| 5,186,667 | A | 2/1993 | Wang |
| 5,206,964 | A | 5/1993 | Wilson, Sr. |
| 5,213,147 | A | 5/1993 | Zheng |
| 5,261,131 | A | 11/1993 | Kilby |
| 5,299,331 | A | 4/1994 | Badillo |
| D349,593 | S | 8/1994 | Hensley |
| 5,334,067 | A | 8/1994 | Henry et al. |
| 5,345,627 | A | 9/1994 | Cammarata |
| 5,358,440 | A | 10/1994 | Zheng |
| 5,385,518 | A | 1/1995 | Turner |
| 5,396,917 | A | 3/1995 | Hazinski et al. |
| 5,430,980 | A | 7/1995 | Ferrier |
| 5,433,433 | A | 7/1995 | Armell |
| 5,435,025 | A | 7/1995 | Gerard et al. |
| 5,454,643 | A | 10/1995 | Sullivan |
| 5,467,794 | A | 11/1995 | Zheng |
| D366,177 | S | 1/1996 | Dean |
| 5,520,561 | A | 5/1996 | Langenohl |
| 5,533,653 | A | 7/1996 | Kaufman |
| 5,560,385 | A | 10/1996 | Zheng |
| 5,571,036 | A | 11/1996 | Hannigan |
| 5,579,799 | A | 12/1996 | Zheng |
| 5,592,961 | A | 1/1997 | Chin |
| D378,772 | S | 4/1997 | Hall |
| 5,618,110 | A | 4/1997 | Sullivan |
| 5,618,246 | A | 4/1997 | Zheng |
| 5,619,759 | A | 4/1997 | Hansen et al. |
| RE35,571 | E | 7/1997 | McLeese |
| 5,644,807 | A | 7/1997 | Battistella |
| 5,688,052 | A | 11/1997 | Compton |
| 5,693,398 | A | 12/1997 | Granger |
| D389,362 | S | 1/1998 | Boulatian |
| 5,718,612 | A | 2/1998 | Elsholz |
| 5,729,846 | A | 3/1998 | Sullivan |
| 5,730,529 | A | 3/1998 | Fritz et al. |
| 5,810,695 | A | 9/1998 | Sass |
| D400,749 | S | 11/1998 | Bechtold, Jr. |
| 5,885,123 | A | 3/1999 | Clifford |
| 5,976,023 | A | 11/1999 | Cho |
| 6,030,300 | A | 2/2000 | Zheng |
| D425,357 | S | 5/2000 | Waring |
| D426,415 | S | 6/2000 | Le Gette et al. |
| 6,073,283 | A | 6/2000 | Zheng |
| 6,113,453 | A | 9/2000 | Stuffelbeam |
| 6,170,100 | B1 | 1/2001 | Le Gette et al. |
| 6,192,635 | B1 | 2/2001 | Zheng |
| 6,223,673 | B1 | 5/2001 | Mears et al. |
| 6,225,940 | B1 | 5/2001 | Ohlsen |
| 6,276,979 | B1 | 8/2001 | Saltel |
| D447,661 | S | 9/2001 | Le Gette et al. |
| D449,193 | S | 10/2001 | Le Gette et al. |
| 6,343,391 | B1 | 2/2002 | Le Gette et al. |
| 6,478,038 | B1 | 11/2002 | Le Gette et al. |
| 6,485,344 | B1 | 11/2002 | Arias |
| 6,634,040 | B1 | 10/2003 | Le Gette et al. |
| 2003/0068940 | A1 | 4/2003 | Arias |

FOREIGN PATENT DOCUMENTS

| | | |
|---|---|---|
| FR | 2697421 | 11/1992 |
| GB | 258077 A | 9/1926 |

OTHER PUBLICATIONS

*Swimways Corp.*, v. *Overbreak, LLC*, Memorandum Opinion, Case No. 1:04cv627, dated Jan. 21, 2005.

Copending U.S. Appl. No. 10/370,082, filed Feb. 21, 2003.

Copending U.S. Appl. No. 10/295,906, filed Nov. 18, 2002.

Copending U.S. Appl. No. 10/847,339, filed May 18, 2004.

Merriam-Websters Collegiate Dictionary (10th ed. 1998) pp. 190, 337, 598.

"How to Fold a Bicycle Tire," http://www.rideyourbike.com/tirefold.html, pp. 1-2.

COLLAPSIBLE FLOTATION DEVICE

CROSS REFERENCE TO RELATED APPLICATION

The present application is a continuation of U.S. application Ser. No. 10/847,339, filed May 18, 2004, which is a continuation of U.S. application Ser. No. 10/295,906, filed Nov. 18, 2002, which is also a continuation of U.S. application Ser. No. 09/772,739, now U.S. Pat. No. 6,485,344, filed Jan. 30, 2001, which claims priority from U.S. Provisional Application Ser. No. 60/238,988, filed Oct. 10, 2000; the disclosures of which are incorporated herein by reference.

BACKGROUND OF THE INVENTION

1. Field of the Invention

The present invention relates to inflatable flotation devices. In particular, the present invention relates to inflatable flotation devices which are collapsible through use of a spring mechanism.

2. Description of the Related Art

Inflatable flotation devices are well known in the form of floats, rafts, lifeboats, life preservers and other like devices. Previously known devices generally maintain their shape through air pressure alone and generally collapse when deflated.

In one of many examples, U.S. Pat. No. 3,775,782 issued to Rice et al. describes an inflatable rescue raft. When deflated, the raft can be rolled into a compact size.

Also well known in the art are collapsible items which are collapsible through the use of a collapsible metal or plastic spring. U.S. Pat. No. 4,815,784 shows an automobile sun shade which uses these collapsible springs. The springs are also used in children's play structures (U.S. Pat. Nos. 5,618,246 and 5,560,385) and tent-like shade structures (U.S. Pat. Nos. 5,579,799 and 5,467,794).

The collapsible springs are typically retained or held within fabric sleeves provided along the edges of a piece of fabric or other panel. The collapsible springs may be provided as one continuous loop, or may be a strip or strips of material connected at the ends to form a continuous loop. These collapsible springs are usually formed of flexible coilable steel, although other materials such as plastics are also used. The collapsible springs are usually made of a material which is relatively strong and yet is flexible to a sufficient degree to allow it to be coiled. Thus, each collapsible spring is capable of assuming two configurations, a normal uncoiled or expanded configuration, and a coiled or collapsed configuration in which the spring is collapsed into a size which is much smaller than its open configuration. The springs may be retained within the respective fabric sleeves without being connected thereto. Alternatively, the sleeves may be mechanically fastened, stitched, fused, or glued to the springs to retain them in position.

SUMMARY OF THE DISCLOSURE

A device comprises a spring and a sleeve. The spring is configured to form a closed loop. The spring is moveable between a coiled configuration when the spring is collapsed and an uncoiled configuration when the spring is expanded. The spring defines a circumference while in the uncoiled configuration. The spring is disposed within the sleeve. The sleeve includes an inflatable portion disposed about at least a portion of the circumference.

It is therefore an object of the present invention to provide a collapsible flotation device.

It is another object of the present invention to provide a collapsible flotation device which is easily collapsed and extended to full size through a mechanical means.

It is yet another object of the present invention to provide a collapsible flotation device which is easily collapsed and extended to fall size through the use of a spring.

It is yet a further object of the present invention to provide a collapsible flotation device which requires minimal force to twist and fold into the collapsed configuration.

Finally, it is an object of the present invention to accomplish the foregoing objectives in a simple and cost effective manner.

DETAILED DESCRIPTION OF THE PREFERRED EMBODIMENTS

Figure 1:
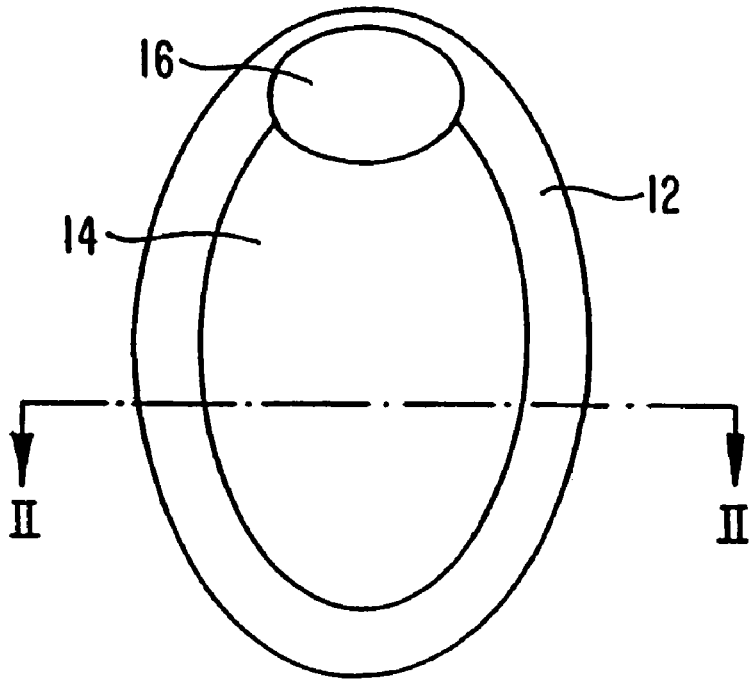
FIG. 1 is a top view of the preferred embodiment of the present invention.

The following detailed description is of the best presently contemplated modes of carrying out the invention. This description is not to be taken in a limiting sense, but is made merely for the purpose of illustrating general principles of embodiments of the invention.

The present invention provides a collapsible flotation device. The device includes a coilable metal or plastic spring. The coilable spring can be made from other materials, however, it is important that the coilable spring be made from a material that is strong and flexible. The spring must be coilable such that it folds on top of itself to become more compact. In its uncoiled state, the coilable spring can be round or oval or any shape satisfactory for use as a flotation device. Because it is to be used in water, the coilable spring is preferably either manufactured from a waterproof material or coated to protect any material which is not waterproof. The coilable spring can be a single continuous element or can include a joining means, such as a sleeve, for joining the ends of one or more spring elements together. The coilable spring can be of any appropriate shape and dimension. The coilable spring also has memory such that is biased to return to its uncoiled configuration when not held in the coiled configuration.

Stretched across the coilable spring is a flexible panel of material. The flexible panel can be one continuous piece or can be made up of several different types of material. In a preferred embodiment, the center portion of the flexible panel is mesh to allow water to flow through while the perimeter edges are nylon or polyester. At the edges of the flotation device, the material is a double thickness, forming a pocket around the perimeter of the flotation device. In this pocket are one or more inflatable chambers. One inflatable chamber may surround the entire perimeter of the flotation device or it may be divided into two or more inflatable chambers with each inflatable chamber having a means for inflating and deflating the inflatable chamber. In a preferred embodiment, one inflatable chamber is specifically designed to accommodate the user's head. In this embodiment, the pocket formed by the material is wider along a small portion of the perimeter of the flotation device to allow for a wider inflatable chamber. This will prevent the user's head from sinking below the rest of the user's body. The size of the inflatable chamber can vary significantly and need only be as wide as necessary to support the user's body weight. A preferred embodiment includes an inflatable chamber which is 3 inches in diameter when inflated. The inflatable chamber can be made from any appropriate float material but is preferably resistant to punctures. The coilable spring may also be located within the perimeter pocket. If one inflatable chamber is selected, the coilable spring can be placed inside or outside the inflatable chamber. If multiple inflatable chambers are used, the coilable spring will be outside the inflatable chambers. Alternatively, the coilable spring may be located outside the perimeter pocket along the outer edge of the flotation device. The coilable spring may be attached to the flexible panel through mechanical means such as fastening, stitching, fusing, or gluing.

Figure 2:
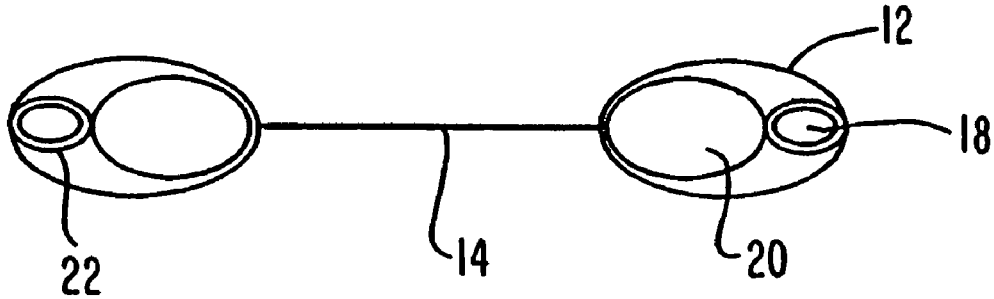
FIG. 2 is a cross sectional view of the preferred embodiment of the present invention taken along line II—II of FIG. 1.
Figure 3:
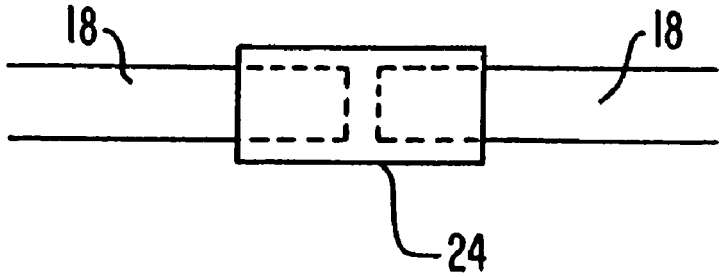
FIG. 3 is a view of a joining method as used in one embodiment of the present invention.

A preferred embodiment of the flotation device is shown in FIGS. 1 and 2 in its expanded configuration. The perimeter pocket 12 portion of the flexible panel is nylon while the central portion 14 of the flexible panel is made from a mesh material. The pillow 16 is part of the perimeter pocket 12 as it includes a double layer of fabric to accept an inflatable chamber 20 between the layers of fabric. In this particular embodiment, there are two inflatable chambers 20 in the perimeter pocket of the flotation device and one in the pillow 16, each of which includes a means for inflating the inflatable chamber 20. The inflation means is a valve on the underside of the flotation device. The inflatable chambers 20 in the perimeter pocket of the flotation device expand to approximately a 3-inch diameter when inflated. The coilable spring 18 is made from flexible, collapsible steel and is coated with a layer of PVC 22 to protect the coilable spring 18 from corroding and rusting due to contact with water during normal use of the flotation device. The coilable spring 18 also has memory such that will open to its uncoiled configuration when not held in the coiled configuration. The coilable spring 18 can be a single unitary element or can include sleeves 24 for joining the ends of one or more strips as shown in FIG. 3 in which the ends of the coilable spring 18 within the sleeve 24 are shown in dashed lines for clarification.

Figure 4:
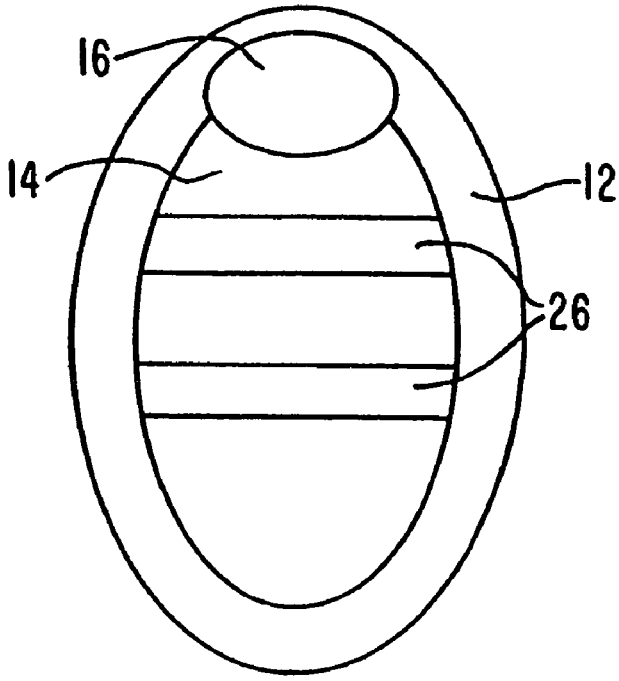
FIG. 4 is a top view of an alternate embodiment of the present invention.
Figure 5:
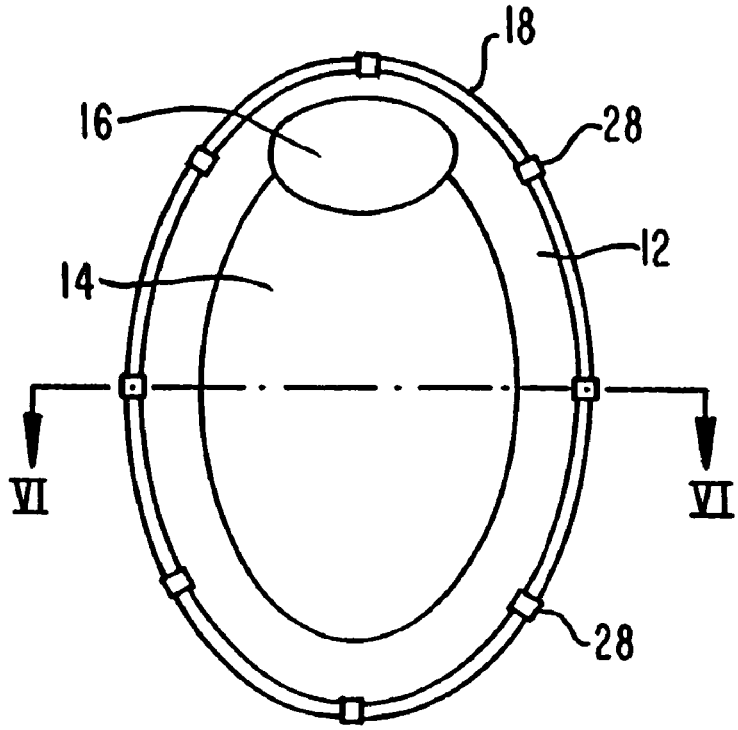
FIG. 5 is a top view of another alternate embodiment of the present invention.
Figure 6:
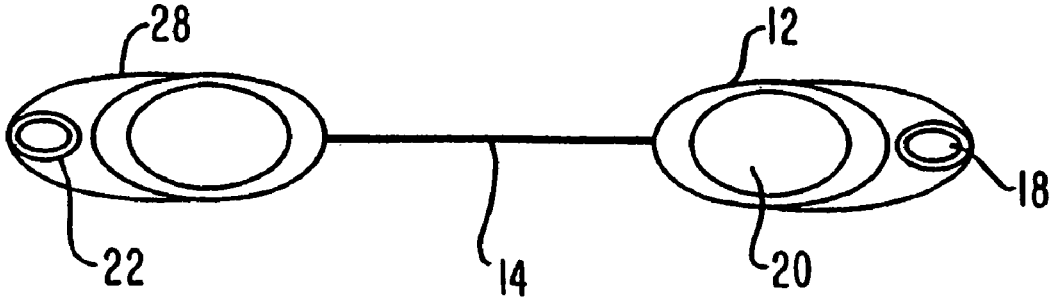
FIG. 6 is a cross section view of the alternate embodiment of the present invention across line VI—VI of FIG. 5.
Figure 7:
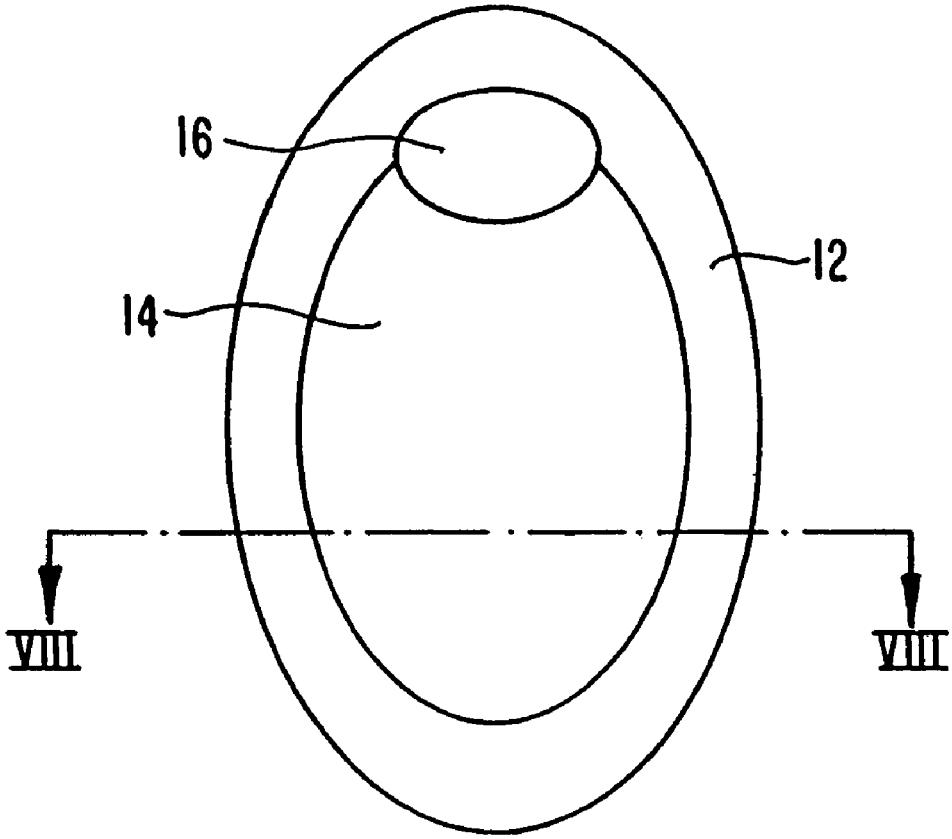
FIG. 7 is a top view of an alternative embodiment of the present invention.
Figure 8:
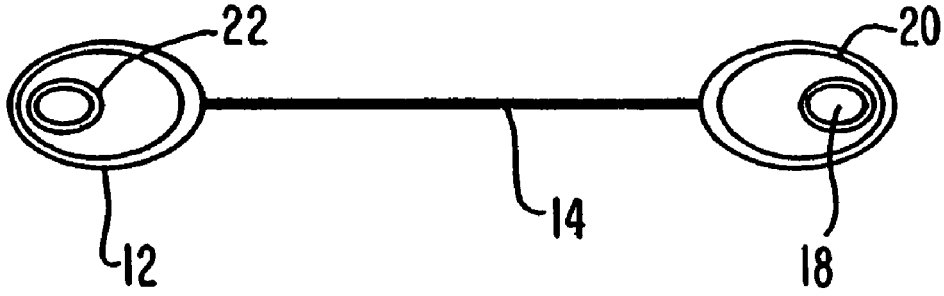
FIG. 8 is a cross sectional view of the embodiment of the present invention, taken along line VIII—VIII of FIG. 7.
Figure 9:
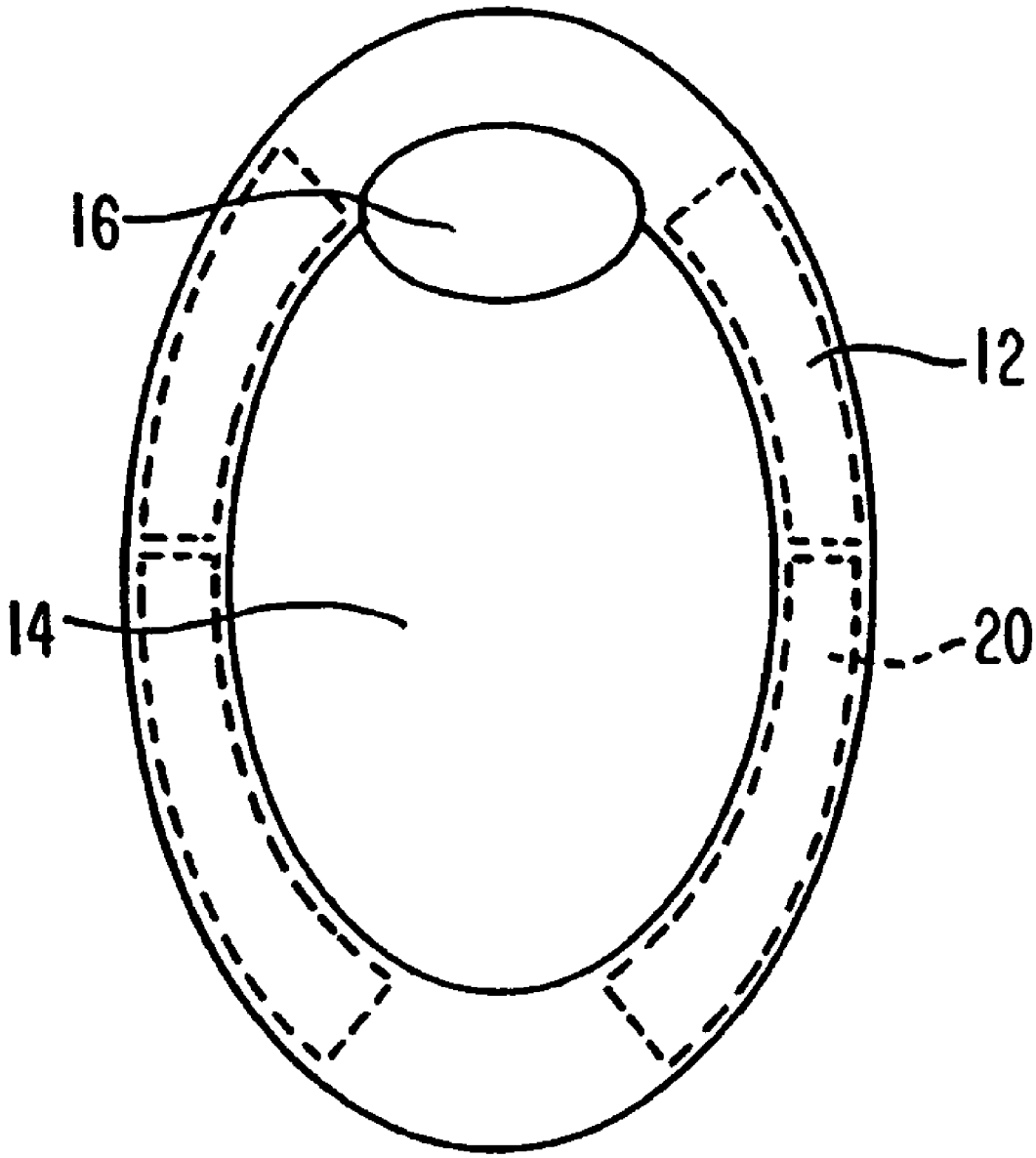
FIG. 9 is a plan view of another embodiment of the present invention.

Alternatively or in addition to the perimeter inflatable chambers, the device can include inflatable chambers 26 which cross the panel as shown in FIG. 4. FIGS. 5 and 6 show a further alternate embodiment of the present invention in which the coilable spring 18 is attached to the external perimeter of the pocket portion 12 of the flexible panel through the use of a mechanical means. In this particular embodiment, several loops 28 are used to attach the coilable spring 18 to the pocket portion 12 of the flexible panel.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An apparatus, comprising:

a spring configured to form a closed loop, the spring being moveable between a coiled configuration when the spring is collapsed and an uncoiled configuration when the spring is expanded, the spring defining a circumference while in the uncoiled configuration;

an inflatable bladder coupled to the spring along at least a portion of the circumference; and an elongated inflatable chamber having a first end and a second end, the first end of the elongated inflatable chamber coupled to the inflatable bladder proximate a location along the circumference, the elongated inflatable chamber extending from its first end to its second end in a direction away from the location along the circumference.

2. The apparatus of claim 1, wherein the elongated inflatable chamber is a first elongated inflatable chamber, the location along the circumference is a first location, the apparatus further comprising a second elongated inflatable chamber coupled to the inflatable bladder proximate a second location along the circumference, the second elongate chamber having a first end and a second end, the second elongated inflatable chamber extending from its first end to its second end in a direction away from the second location along the circumference.

3. The apparatus of claim 1, wherein the spring includes a first end and a second end opposite the first end, the first end of the spring being coupled to the second end of the spring while in the coiled configuration and while in the uncoiled configuration.

4. The apparatus of claim 1, wherein the spring is made of plastic.

5. The apparatus of claim 1, wherein the spring is disposed within the inflatable bladder.

6. The apparatus of claim 1, wherein the spring has a circular shape when in an uncoiled configuration.

7. The apparatus of claim 1, wherein the elongated inflatable chamber is in gaseous communication with the inflatable bladder.

8. An apparatus, comprising:

a spring configured to form a closed loop, the spring being moveable between a coiled configuration when the spring is collapsed and an uncoiled configuration when the spring is expanded, the spring defining a circumference while in the uncoiled configuration;

a first flotation member fixedly attached to the spring, the first flotation member disposed about at least a portion of the circumference of the spring; and a second flotation member coupled to one of the first flotation member or the spring, the second flotation member having a first end and a second end, the first end of the second flotation member coupled to one of the first flotation member or the spring proximate a location along the circumference, the second flotation member extending from its first end to its second end in a direction away from the location along the circumference.

9. The apparatus of claim 8, wherein the location along the circumference is a first location, the apparatus further comprising a third flotation member coupled to the first flotation member proximate a second location along the circumference, the third flotation member having a first end and a second end, the third flotation member extending from its first end to its second end in a direction away from the second location along the circumference.

10. The apparatus of claim 8, wherein the second flotation member is in gaseous communication with the first flotation member.

11. The apparatus of claim 8, wherein the spring has a circular shape when in the uncoiled configuration.

12. The apparatus of claim 8, wherein the spring is disposed within the first flotation member.

13. An apparatus, comprising:

a spring configured to form a closed loop, the spring being moveable between a coiled configuration when the spring is collapsed and an uncoiled configuration when the spring is expanded, the spring defining a circumference while in the uncoiled configuration;

a first material;

a second material coupled to the first material, the first material and the second material collectively defining a first inflatable chamber, at least a portion of the spring being disposed between the first material and the second material; and an elongated member coupled to at least one of the first material or the second material, the elongated member defining a second inflatable chamber.

14. The apparatus of claim 13, wherein the first inflatable chamber is in gaseous communication with the second inflatable chamber.

15. The apparatus of claim 13, wherein the elongated member has a first end and a second end, the first end of elongated member coupled to at least one of the first material or the second material proximate a location along the circumference, the elongated member extending from its first end to its second end in a direction away from the location along the circumference.

16. The apparatus of claim 13, wherein the spring has a circular shape when in the uncoiled configuration.

17. The apparatus of claim 13, wherein the elongated member is a first elongated member, the apparatus further comprising a second elongated member coupled to at least one of the first material or the second material, the second elongated member defining a third inflatable chamber.

18. The apparatus of claim 13, wherein the elongated member is a first elongated member, the apparatus further comprising a second elongated member coupled to at least one of the first material or the second material, the second elongated member being in gaseous communication with the first elongated member.

19. The apparatus of claim 13, wherein the spring is disposed within the first material and the second material.

* * * * *